US006258990B1

(12) United States Patent
Fung et al.

(10) Patent No.: US 6,258,990 B1
(45) **Date of Patent: *Jul. 10, 2001**

(54) PROCESS FOR PRODUCING POLYPROPYLENE FROM $C_3$ OLEFINS SELECTIVELY PRODUCED IN A FLUID CATALYTIC CRACKING PROCESS FROM A NAPHTHA/STEAM FEED

(75) Inventors: Shun C. Fung, Bridgewater, NJ (US); Tan-Jen Chen, Kingwood, TX (US); Marcel J. Janssen, Kessel-Lo (BE); William A. Wachter, Baton Rouge, LA (US); B. Erik Henry, Katy; John E. Asplin, Houston, both of TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/517,497

(22) Filed: Mar. 2, 2000

Related U.S. Application Data

(63) Continuation-in-part of application No. 09/072,632, filed on May 5, 1998, now Pat. No. 6,118,035.

(51) Int. Cl.[7] ..... C07C 4/06; C10G 11/00

(52) U.S. Cl. ..... 585/330; 585/324; 585/329; 585/648; 585/651; 585/652; 585/653; 208/113; 208/120.01; 208/121

(58) Field of Search ..... 585/324, 329, 585/330, 648, 651, 652, 653; 208/113, 120.01, 121

(56) References Cited

U.S. PATENT DOCUMENTS

| | | | | |
|---|---|---|---|---|
| 3,442,792 | | 5/1969 | Eng et al. | 208/62 |
| 3,893,905 | * | 7/1975 | Fenske et al. | 208/103 |
| 3,928,172 | | 12/1975 | Davis, Jr. et al. | 208/77 |
| 4,171,257 | | 10/1979 | O'Rear et al. | 208/120 |
| 4,282,085 | | 8/1981 | O'Rear et al. | 208/120 |
| 4,502,945 | | 3/1985 | Olbrich et al. | 208/120 |
| 4,830,728 | | 5/1989 | Herbst et al. | 208/78 |
| 4,865,718 | | 9/1989 | Herbst et al. | 208/70 |
| 4,950,387 | | 8/1990 | Harandi et al. | 208/49 |
| 5,026,935 | | 6/1991 | Leyshon et al. | 585/315 |
| 5,026,936 | | 6/1991 | Leyshon et al. | 585/315 |
| 5,043,522 | | 8/1991 | Leysohn et al. | 585/651 |
| 5,069,776 | | 12/1991 | Biswas et al. | 208/120 |
| 5,160,424 | | 11/1992 | Le et al. | 208/67 |
| 5,171,921 | | 12/1992 | Gaffney et al. | 585/653 |
| 5,292,976 | | 3/1994 | Dessau et al. | 585/322 |
| 5,372,704 | | 12/1994 | Harandi et al. | 208/74 |
| 5,378,352 | | 1/1995 | Degnan et al. | 208/217 |
| 5,389,232 | | 2/1995 | Adewuyi et al. | 208/120 |
| 5,396,010 | | 3/1995 | Harandi et al. | 585/418 |
| 5,414,172 | | 5/1995 | Chin et al. | 585/322 |
| 5,472,594 | | 12/1995 | Tsang et al. | 208/114 |
| 5,865,987 | | 2/1999 | Borghard et al. | 208/97 |
| 5,865,988 | | 2/1999 | Collins et al. | 208/97 |
| 6,069,287 | * | 5/2000 | Ladwig et al. | 585/648 |
| 6,093,867 | * | 7/2000 | Ladwig et al. | 585/648 |
| 6,106,697 | * | 8/2000 | Swan et al. | 208/77 |
| 6,118,035 | * | 9/2000 | Fung et al. | 585/653 |

FOREIGN PATENT DOCUMENTS

| | | |
|---|---|---|
| 0347003 B1 | 5/1996 | (EP) . |
| WO98/56874 | 12/1998 | (WO) . |

* cited by examiner

*Primary Examiner*—Walter D. Griffin
(74) *Attorney, Agent, or Firm*—Michael A. Cromwell

(57) ABSTRACT

A process for producing polymers from $C_2$–$C_4$ olefins selectively produced from a catalytically-cracked or thermally-cracked naphtha stream is disclosed herein. A mixture of the naphtha stream and a stream of steam is feed into a reaction zone where it is contacted with a catalyst containing from about 10 to 50 wt. % of a crystalline zeolite having an average pore diameter less than about 0.7 nanometers at reaction conditions that include temperatures from about 500° C. to 650° C. and a hydrocarbon partial pressure from about 10 to 40 psia.

18 Claims, No Drawings

PROCESS FOR PRODUCING POLYPROPYLENE FROM $C_3$ OLEFINS SELECTIVELY PRODUCED IN A FLUID CATALYTIC CRACKING PROCESS FROM A NAPHTHA/STEAM FEED

CROSS-REFERENCE TO RELATED APPLICATION

This is a continuation-in-part of U.S. application Ser. No. 09/072,632 filed May 5, 1998, now U.S. Pat. No. 6,118,035.

FIELD OF THE INVENTION

The present invention relates to a process for producing polypropylene from $C_3$ olefins selectively produced from a catalytically cracked or thermally cracked naphtha stream.

BACKGROUND OF THE INVENTION

The need for low-emissions fuels has created an increased demand for light olefins used in alkylafion, oligomerization, MTBE, and ETBE synthesis processes. In addition, a low-cost supply of light olefins, particularly propylene, continues to be in demand to serve as feedstock for polyolefin, particularly polypropylene production.

Fixed bed processes for light paraffin dehydrogenation have recently attracted renewed interest for increasing olefin production. However, these types of processes typically require relatively large capital investments and high operating costs. It is therefore advantageous to increase olefin yield using processes that require relatively small capital investment. It would be particularly advantageous to increase olefin yield in catalytic cracking processes.

A problem inherent in producing olefin products using FCC units is that the process depends on a specific catalyst balance to maximize production of light olefins while also achieving high conversion of the 650° F.+(340° C.+) feed components. In addition, even if a specific catalyst balance can be maintained to maximize overall olefin production, olefin selectivity is generally low because of undesirable side reactions, such as cracking, isomerization, aromatization and hydrogen transfer reactions. Light saturated gases produced from undesirable side reactions result in increased costs to recover the desirable light olefins. Therefore, it is desirable to maximize olefin production in a process that allows a high degree of control over the selectivity to $C_2$–$C_4$ olefins.

SUMMARY OF THE INVENTION

One embodiment of the present invention is a process for producing polypropylene comprising the steps of (a) feeding steam and a naphtha feed containing between about 10 and 30 wt. % paraffins and between about 15 and about 70 wt. % olefins into a reaction zone; (b) contacting the naphtha feed with a catalyst comprising a crystalline zeolite having an average pore diameter less than about 0.7 nm at conditions including a temperature from about 500° to 650° C., a hydrocarbon partial pressure of 10 to 40 psia, a hydrocarbon residence time of 1 to 10 seconds, and a catalyst to feed weight ratio of about 4 to about 10, wherein no more than about 20 wt. % of paraffins are converted to olefins, wherein polypropylene comprises at least about 90 mol.% of the total $C_3$ products; and, (c) separating the propylene from the $C_3$ products and polymerizing the propylene to form polypropylene.

In a preferred embodiment of the present invention the crystalline zeolite is selected from the ZSM series.

In another preferred embodiment of the present invention the catalyst is a ZSM-5 type catalyst.

In still another preferred embodiment of the present invention the feedstock contains about 10 to 30 wt. % paraffins, and from about 20 to 70 wt. % olefins.

In yet another preferred embodiment of the present invention the reaction zone is operated at a temperature from about 525° C. to about 600° C.

DETAILED DESCRIPTION OF THE INVENTION

Feeds that are suitable for producing the relatively high $C_2$, $C_3$, and $C_4$ olefin yields are streams boiling in the naphtha range and containing from about 5 wt. % to about 35 wt. %, preferably from about 10 wt. % to about 30 wt. %, and more preferably from about 10 to 25 wt. % paraffins, and from about 15 wt. %, preferably from about 20 wt. % to about 70 wt. % olefins. The feed may also contain naphthenes and aromatics. Naphtha boiling range streams are typically those having a boiling range from about 65° F. to about 430° F. (18-225° C.), preferably from about 65° F. to about 300° F. (18-150° C.).

The naphtha feed may be a thermally-cracked or a catalytically-cracked naphtha derived from any appropriate source. The naphtha streams may derive from the fluid catalytic cracking (FCC) of gas oils and resids or from delayed- or fluid-coking of resids. Preferably, the naphtha streams used in the present invention derive from the fluid catalytic cracking of gas oils and resids because these naphthas are typically rich in olefins and/or diolefins and relatively lean in paraffins.

The process of the present invention is performed in a process unit comprising a reaction zone, a stripping zone, a catalyst regeneration zone, and a fractionation zone. The naphtha feed is fed into the reaction zone as a mixture of naphtha and steam, where it contacts a source of hot, regenerated catalyst. The hot catalyst vaporizes and cracks the feed at a temperature from about 500° C. to 650° C., preferably from about 525° C. to 600° C. The cracking reaction deposits coke on the catalyst, thereby deactivating the catalyst. The cracked products are separated from the coked catalyst and sent to a fractionator. The coked catalyst is passed through the stripping zone where volatiles are stripped from the catalyst particles with a stripping medium such as steam. The stripping can be performed under low severity conditions to retain a greater fraction of adsorbed hydrocarbons for heat balance. The stripped catalyst is then passed to the regeneration zone where it is regenerated by burning at least a portion of the coke on the catalyst in the presence of an oxygen containing gas, preferably air. Decoking restores catalyst activity and simultaneously heats the catalyst to between 650° C. and 750° C. The hot regenerated catalyst is then recycled to the reaction zone to react with fresh naphtha feed. Flue gas formed by burning coke in the regenerator may be treated for removal of particulates and for conversion of carbon monoxide. The cracked products from the reaction zone are sent to a fractionation zone where various products are recovered, particularly a $C_3$ fraction, a $C_4$ fraction rich in olefins, and a $C_5$ fraction rich in olefins.

The amount of steam co-fed with the naphtha feed will typically be in the range of about 10 to 250 mol. %, preferably from about 25 to 150 mol. % steam to naphtha.

While attempts have been made to increase light olefins yields in the FCC process unit itself, the present invention uses its own distinct process unit, as previously described, and receives naphtha from a suitable source in the refinery.

The reaction zone is operated at process conditions that will maximize $C_2$ to $C_4$ olefin (particularly propylene) selectivity with relatively high conversion of $C_5$+ olefins. Catalysts suitable for use in the practice of the present invention are those comprising a crystalline zeolite having an average pore diameter less than about 0.7 nanometers (nm), said crystalline zeolite comprising from about 10 wt. % to about 50 wt. % of the total fluidized catalyst composition. It is preferred that the crystalline zeolite be selected from the family of medium-pore-size (<0.7 nm) crystalline aluminosilicates, otherwise referred to as zeolites. Of particular interest are the medium-pore zeolites with a silica to alumina molar ratio of less than about 75:1, preferably less than about 50:1, and more preferably less than about 40:1, although some embodiments may have silica to alumina ratios greater than 40:1. The pore diameter, also referred to as effective pore diameter, is measured using standard adsorption techniques and hydrocarbonaceous compounds of known minimum kinetic diameters. See Breck, *Zeolite Molecular Sieves*, 1974 and Anderson et al., J. Catalysis 58, 114 (1979), both of which are incorporated herein by reference.

Medium-pore-size zeolites that can be used in the practice of the present invention are described in "Atlas of Zeolite Structure Types," eds. W. H. Meier and D. H. Olson, Butterworth-Heineman, Third Edition, 1992, which is hereby incorporated by reference. The medium-pore-size zeolites generally have a pore size from about 5 Å, to about 7 Å and include for example, MFI, MFS, MEL, MTW, EUO, MTT, HEU, FER, and TON structure type zeolites (IUPAC Commission of Zeolite Nomenclature). Non-limiting examples of such medium-pore-size zeolites, include ZSM-5, ZSM-12, ZSM-22, ZSM-23, ZSM-34, ZSM-35, ZSM-38, ZSM-48, ZSM-50, silicalite, and silicalite 2. The most preferred is ZSM-5, which is described in U.S. Pat. Nos. 3,702,886 and 3,770,614. ZSM-11 is described in U.S. Pat. No. 3,709,979; ZSM-12 in U.S. Pat. No. 3,832,449; ZSM-21 and ZSM-38 in U.S. Pat. No. 3,948,758; ZSM-23 in U.S. Pat. No. 4,076,842; and ZSM-35 in U.S. Pat. No. 4,016,245. All of the above patents are incorporated herein by reference. Other suitable medium-pore-size zeolites include the silicoaluminophosphates (SAPO), such as SAPO-4 and SAPO- 11 which is described in U.S. Pat. No. 4,440,871; chromosilicates; gallium silicates; iron silicates; aluminum phosphates (ALPO), such as ALPO-11 described in U.S. Pat. No. 4,310,440; titanium aluminosilicates (TASO), such as TASO-45 described in EP-A No. 229,295; boron silicates, described in U.S. Pat. No. 4,254,297; titanium aluminophosphates (TAPO), such as TAPO- 1I described in U.S. Pat. No. 4,500,651; and iron aluminosilicates.

The medium-pore-size zeolites can include "crystalline admixtures" that are thought to be the result of faults occurring within the crystal or crystalline area during the synthesis of the zeolites. Examples of crystalline admixtures of ZSM-5 and ZSM-11 are disclosed in U.S. Pat. No. 4,229,424 which is incorporated herein by reference. The crystalline admixtures are themselves medium-pore-size zeolites and are not to be confused with physical admixtures of zeolites in which distinct crystals of crystallites of different zeolites are physically present in the same catalyst composite or hydrothermal reaction mixtures.

The catalysts of the present invention are held together with an inorganic oxide matrix material component. The inorganic oxide matrix component binds the catalyst components together so that the catalyst product is hard enough to survive interparticle and reactor wall collisions. The inorganic oxide matrix can be made from an inorganic oxide sol or gel that is dried to "bind" the catalyst components together. Preferably, the inorganic oxide matrix is not catalytically active and will comprise oxides of silicon and aluminum. It is also preferred that separate alumina phases be incorporated into the inorganic oxide matrix. Species of aluminum oxyhydroxides-γ-alumina, boehmite, diaspore, and transitional aluminas such as α-alumina, β-alumina, γ-alumina, δ-alumina, ε-alumina, κ-alumina, and ρ-alumina can be employed. Preferably, the alumina species is an aluminum trihydroxide such as gibbsite, bayerite, nordstrandite, or doyelite. The matrix material may also contain phosphorous or aluminum phosphate.

Preferred process conditions include temperatures from about 500° C. to about 650° C., preferably from about 500° C. to 600° C.; hydrocarbon partial pressures from about 10 to 40 psia (70–280 kPa), preferably from about 20 to 35 psia (140–245 kPa); and a catalyst to naphtha (wt/wt) ratio from about 3 to 12, preferably from about 4 to 10, where catalyst weight is total weight of the catalyst composite. Preferably, the naphtha residence time in the reaction zone is less than about 10 seconds, for example from about 1 to 10 seconds. The reaction conditions will be such that at least about 60 wt. % of the $C_5$+ olefins in the naphtha stream are converted to $C_4$− products and less than about 25 wt. %, preferably less than about 20 wt. % of the paraffins are converted to $C_4$− products, and that propylene comprises at least about 90 mol. %, preferably greater than about 95 mol. % of the total $C_3$ reaction products with the weight ratio of propylene/total $C_2$− products greater than about 3.5.

Preferably, ethylene comprises at least about 90 mol. % of the $C_2$ products, with the weight ratio of propylene:ethylene being greater than about 4, and that the "full range" $C_5$+ product is enhanced in both motor and research octanes relative to the naphtha feed. It is within the scope of this invention to pre-coke the catalysts before introducing the feed to further improve the selectivity to propylene. It is also within the scope of this invention to feed an effective amount of single ring aromatics to the reaction zone to improve the selectivity of propylene versus ethylene. The aromatics may be from an external source such as a reforming process unit or they may consist of heavy naphtha recycle product from the instant process.

The following examples are presented for illustrative purposes only and are not to be taken as limiting the present invention in any way.

EXAMPLES 1–12

The following examples illustrate the criticality of process operating conditions for maintaining chemical grade propylene purity with samples of cat naphtha cracked over ZCAT-40 (a catalyst that contains ZSM-5) that had been steamed at 1500° F. (815° C.) for 16 hrs to simulate commercial equilibrium. Comparison of Examples 1 and 2 show that increasing Cat/Oil ratio improves propylene yield, but sacrifices propylene purity. Comparison of Examples 3 and 4 and 5 and 6 shows reducing oil partial pressure greatly improves propylene purity without compromising propylene yield. Comparison of Examples 7 and 8 and 9 and 10 shows increasing temperature improves both propylene yield and purity. Comparison of Examples 11 and 12 shows decreasing cat residence time improves propylene yield and purity. Example 13 shows an example where both high propylene yield and purity are obtained at a reactor temperature and cat/oil ratio that can be achieved using a conventional FCC reactor/regenerator design for the second stage.

TABLE 1

| Example | Feed Olefins, wt. % | Temp. ° C. | Cat/Oil | Oil psia | Oil Res. Time, sec | Cat Res. Time, sec | Wt. % $C_3^=$ |
|---|---|---|---|---|---|---|---|
| 1 | 38.6 | 566 | 4.2 | 36 | 0.5 | 4.3 | 11.4 |
| 2 | 38.6 | 569 | 8.4 | 32 | 0.6 | 4.7 | 12.8 |
| 3 | 22.2 | 510 | 8.8 | 18 | 1.2 | 8.6 | 8.2 |
| 4 | 22.2 | 511 | 9.3 | 38 | 1.2 | 5.6 | 6.3 |
| 5 | 38.6 | 632 | 16.6 | 20 | 1.7 | 9.8 | 16.7 |
| 6 | 38.6 | 630 | 16.6 | 13 | 1.3 | 7.5 | 16.8 |
| 7 | 22.2 | 571 | 5.3 | 27 | 0.4 | 0.3 | 6.0 |
| 8 | 22.2 | 586 | 5.1 | 27 | 0.3 | 0.3 | 7.3 |
| 9 | 22.2 | 511 | 9.3 | 38 | 1.2 | 5.6 | 6.3 |
| 10 | 22.2 | 607 | 9.2 | 37 | 1.2 | 6.0 | 10.4 |
| 11 | 22.2 | 576 | 18.0 | 32 | 1.0 | 9.0 | 9.6 |
| 12 | 22.2 | 574 | 18.3 | 32 | 1.0 | 2.4 | 10.1 |
| 13 | 38.6 | 606 | 8.5 | 22 | 1.0 | 7.4 | 15.0 |

| Example | Wt. % $C_3^-$ | Propylene Purity % | Wt. % $C_2^=$ | Wt. % $C_2^-$ | Ratio of $C_3^=$ to $C_2^=$ | Ratio of $C_3^=$ to $C_3^-$ | Wt. % $C_3^=$ |
|---|---|---|---|---|---|---|---|
| 1 | 0.5 | 95.8% | 2.35 | 2.73 | 4.9 | 4.2 | 11.4 |
| 2 | 0.8 | 94.1% | 3.02 | 3.58 | 4.2 | 3.6 | 12.8 |
| 3 | 1.1 | 88.2% | 2.32 | 2.53 | 3.5 | 3.2 | 8.2 |
| 4 | 1.9 | 76.8% | 2.16 | 2.46 | 2.9 | 2.6 | 6.3 |
| 5 | 1.0 | 94.4% | 6.97 | 9.95 | 2.4 | 1.7 | 16.7 |
| 6 | 0.6 | 96.6% | 6.21 | 8.71 | 2.7 | 1.9 | 16.8 |
| 7 | 0.2 | 96.8% | 1.03 | 1.64 | 5.8 | 3.7 | 6.0 |
| 8 | 0.2 | 97.3% | 1.48 | 2.02 | 4.9 | 3.6 | 7.3 |
| 9 | 1.9 | 76.8% | 2.16 | 2.46 | 2.9 | 2.6 | 6.3 |
| 10 | 2.2 | 82.5% | 5.21 | 6.74 | 2.0 | 1.5 | 10.4 |
| 11 | 4.0 | 70.6% | 4.99 | 6.67 | 1.9 | 1.4 | 9.6 |
| 12 | 1.9 | 84.2% | 4.43 | 6.27 | 2.3 | 1.6 | 10.1 |
| 13 | 0.7 | 95.5% | 4.45 | 5.76 | 3.3 | 2.6 | 15.0 |

$C_2^- = CH_4 + C_2H_4 + C_2H_6$

The above examples (1,2,7 and 8) show that $C_3=/C_2=>4$ and $C_3=/C_2-->3.5$ can be achieved by selection of suitable reactor conditions.

EXAMPLES 14–17

The cracking of olefins and paraffins contained in naphtha streams (e.g. cat naphtha, coker naphtha) over small or medium-pore zeolites such as ZSM-5 can produce significant amounts of ethylene and propylene. The selectivity to ethylene or propylene and selectivity of propylene to propane varies as a finction of catalyst and process operating conditions. It has been found that propylene yield can be increased by co-feeding steam along with cat naphtha to the reactor. The catalyst may be ZSM-5 or other small or medium-pore zeolites. Table 2 below illustrates the increase in propylene yield when 5 wt. % steam is co-fed with a cat naphtha containing 38.8 wt % olefins. Although propylene yield increased, the propylene purity is diminished. Thus, other operating conditions may need to be adjusted to maintain the targeted propylene selectivity.

Light olefins resulting from the preferred process may be used as feeds for processes such as oligomerization, polymerization, co-polymerization, ter-polymerization, and related processes (hereinafter "polymerization") to form macromolecules. Such light olefins may be polymerized both alone and in combination with other species, in accordance with polymerization methods known in the art. In some cases it may be desirable to separate, concentrate, purify, upgrade, or otherwise process the light olefins prior to polymerization. Propylene and ethylene are preferred polymerization feeds. Polypropylene and polyethylene are preferred polymerization products made therefrom.

What is claimed is:

1. A process for producing polypropylene comprising the steps of:

(a) feeding steam and a naphtha feed containing between about 10 and 30 wt. % paraffins and between about 15 and about 70 wt. % olefins into a reaction zone;

(b) contacting the naphtha feed with a catalyst comprising 10 to 50 wt. % of a crystalline zeolite having an average pore diameter less than about 0.7 nm at conditions including a temperature from about 500° C. to 650° C., a hydrocarbon partial pressure of 10 to 40 psia, a hydrocarbon residence time of 1 to 10 seconds, and a catalyst to feed weight ratio of about 4 to about 10, wherein no more than about 20 wt. % of paraffins are converted to olefins, wherein propylene comprises at least about 90 mol. % of the total $C_3$ products; and, (c) separating the propylene from the $C_3$ products and polymerizing the propylene to form polypropylene.

2. The process of claim 1 wherein the amount of steam fed into the reaction zone with the naphtha feedstock is from about 1 to 50 mol. %.

3. The process of claim 1 wherein the crystalline zeolite is selected from the ZSM series.

4. The process of claim 3 wherein the crystalline zeolite is ZSM-5.

5. The process of claim 4 wherein the reaction temperature is from about 500° C. to about 600° C.

6. The process of claim 5 wherein at least about 60 wt. % of the $C_5$ + olefins in the feed is converted to $C_4$− products and less than about 25 wt. % of the paraffins are converted to $C_4$− products.

7. The process of claim 1 wherein propylene comprises at least 95 mol. % of the total $C_3$ products.

8. The process of claim 7 wherein the weight ratio of propylene to total $C_2$− products is greater than about 3.5.

9. The process of claim 8 wherein the amount of steam fed into the reaction zone with the naphtha feedstock is from about 2 to 20 mol. %.

10. A process for producing a polypropylene comprising the steps of:

(a) feeding steam and a naphtha feed containing between about 10 and 30 wt. % paraffins and between about 15 and about 70 wt. % olefins into a reaction zone;

TABLE 2

| Example | Steam Co-feed | Temp. C. | Cat/Oil | Oil psia | Oil Res. Time, sec | Cat Res. Time, sec | Wt % Propylene | Wt % Propane | Propylene Purity, % |
|---|---|---|---|---|---|---|---|---|---|
| 14 | No | 630 | 8.7 | 18 | 0.8 | 8.0 | 11.7 | 0.3 | 97.5% |
| 15 | Yes | 631 | 8.8 | 22 | 1.2 | 6.0 | 13.9 | 0.6 | 95.9% |
| 16 | No | 631 | 8.7 | 18 | 0.8 | 7.8 | 13.6 | 0.4 | 97.1% |
| 17 | Yes | 632 | 8.4 | 22 | 1.1 | 6.1 | 14.6 | 0.8 | 94.8% |

(b) contacting the naphtha feed with a catalyst comprising a crystalline zeolite having an average pore diameter less than about 0.7 nm at conditions including a temperature from about 500° C. to 650° C., a hydrocarbon partial pressure of 10 to 40 psia, a hydrocarbon residence time of 1 to 10 seconds, and a catalyst to feed weight ratio of about 4 to about 10, wherein no more than about 20 wt. % of paraffins are converted to olefins, wherein propylene comprises at least about 90 mol. % of the total $C_3$ products; and, (c) separating the propylene from the $C_3$ products and polymerizing the propylene to form polypropylene.

11. The process according to claim 10 wherein propylene comprises at least about 95 mol. % of the total $C_3$ products.

12. The process of claim 10 wherein the amount of steam fed into the reaction zone with the naphtha feedstock is from about 1 to 50 mol. %.

13. The process of claim 10 wherein the crystalline zeolite is selected from the ZSM series.

14. The process of claim 13 wherein the crystalline zeolite is ZSM-5.

15. The process of claim 14 wherein the reaction temperature is from about 500° C. to about 6000 C.

16. The process of claim 15 wherein at least about 60 wt. % of the $C_5$ + olefins in the feed is converted to $C_4$− products and less than about 25 wt. % of the paraffins are converted to $C_4$− products.

17. The process of claim 16 wherein the weight ratio of propylene to total $C_2$− products is greater than about 3.5.

18. The process of claim 17 wherein the amount of steam fed into the reaction zone with the naphtha feedstock is from about 2 to 20 mol. %.

* * * * *